United States Patent [19]

Schreiner

[11] 4,349,113

[45] Sep. 14, 1982

[54] WALL-HUNG SUPPORT RAIL

[75] Inventor: Charles P. Schreiner, Saugatuck, Mich.

[73] Assignee: Westinghouse Electric Corp., Pittsburgh, Pa.

[21] Appl. No.: 212,944

[22] Filed: Dec. 4, 1980

[51] Int. Cl.[3] ..... A47F 5/00

[52] U.S. Cl. ..... 211/103; 211/88; 211/126; 211/208

[58] Field of Search ..... 211/90, 87, 207, 191, 211/208, 126, 88, 193, 190, 94; 52/36; 108/108

[56] References Cited

U.S. PATENT DOCUMENTS

| | | | |
|---|---|---|---|
| 2,678,793 | 5/1954 | Brochstein | 108/108 X |
| 2,955,715 | 10/1960 | Carlson | 211/207 |
| 3,212,646 | 10/1965 | Propst | 211/87 |
| 3,572,874 | 3/1971 | Hassel | 312/350 |
| 3,698,565 | 10/1972 | Weber | 211/87 |
| 3,712,698 | 1/1973 | Propst et al. | 312/350 |
| 3,886,698 | 6/1975 | Raith et al. | 211/87 X |
| 3,924,829 | 12/1975 | Boundy | 211/193 X |
| 4,180,298 | 12/1979 | Borgerson | 312/242 |
| 4,189,123 | 2/1980 | Johnson | 52/36 X |
| 4,228,906 | 10/1980 | Jones | 211/126 |

FOREIGN PATENT DOCUMENTS

| | | | |
|---|---|---|---|
| 651895 | 11/1962 | Canada | 211/191 |

*Primary Examiner*—Roy D. Frazier
*Assistant Examiner*—Robert W. Gibson, Jr.
*Attorney, Agent, or Firm*—Blair R. Studebaker

[57] ABSTRACT

A support rail for the cantilevered mounting of material handling totes to a wall or similar vertical surface having slotted standards thereon. The support rail includes a pair of spaced, two-part brackets mounted to each end of a pair of spaced, parallel rails having a predetermined spacing therebetween. The brackets are mountable to the slotted standard by a plurality of hook-shaped connectors.

8 Claims, 6 Drawing Figures

WALL-HUNG SUPPORT RAIL

BACKGROUND OF THE INVENTION

This invention relates to material handling carts and more particularly to a material handling cart adapted for storing and transporting material handling totes.

In modern manufacturing processes, particularly those employed in the electronics industry, there is a need for a facility to handle large numbers of comparatively small electronic parts such as printed circuit boards and the like. During these manufacturing processes, there is a need to store parts and subassemblies at various stages of the process. For example, the parts and subassemblies need to be stored in large storage areas in large numbers and to have the ability to be moved in large quantities by industrial fork trucks and the like. These parts in smaller numbers also need to be moved from storage areas to work areas by handcarts and the like and to be stored at work areas under work surfaces or on vertical wall surfaces for access by manufacturing personnel.

A system has been developed which employs a uniquely designed material handling tote of the type disclosed in U.S. patent application Ser. No. 212,946, filed the same date as this application for MATERIAL HANDLING TOTE by Charles P. Schreiner et al. This material handling tote may be employed in a total material handling system and may be, for example, stored in large numbers on a pallet frame of the type disclosed in U.S. patent application Ser. No. 212,953, filed by Charles P. Schreiner for a PALLET FRAME the same date as this application. The material handling tote may also be moved from place to place and stored on a sturdy, lightweight material handling cart of the type disclosed in copending application Ser. No. 212,954, filed the same date as this application by Charles P. Schreiner for a MATERIAL HANDLING CART. Additionally, the material handling tote may be supported in a cantilevered fashion by the wall-hung support rail which forms the subject matter of this application or stored beneath a work surface on pairs of tote guides of the type disclosed in copending application Ser. No. 212,945, filed the same date as this application by Charles P. Schreiner for TOTE GUIDE. Each of the foregoing applications are owned by the same assignee as this application.

SUMMARY OF THE INVENTION

The wall-hung support rail of this invention may be employed to store material handling totes and the like adjacent to work stations to provide manufacturing personnel ready access to stored materials. The support rail of this invention is designed for use in connection with a panel or similar vertical support member having spaced vertical slotted standards thereon and includes a pair of vertically spaced horizontal rail members spaced one from the other by a predetermined distance. A first L-shaped bracket is secured to each end of the pair of rail members and a second L-shaped bracket is secured to each of the first L-shaped brackets in a manner to cause a plurality of hook-shaped connectors on the edge of each of the second L-shaped bracket extending perpendicular to the rail members to be arranged to co-act with the slotted standard to connect the support rail to the vertical surface. At one end of the pair of vertically spaced horizontal rail members the L-shaped brackets are welded together while at the other end the L-shaped brackets are bolted together in order to vary slightly the spaced relationship between the pair of second L-shaped brackets. Each of the support rails are tubular and include a flat back portion and a front portion that is parallel with the back portion of its lower half and tapered toward the back portion for its upper half.

BRIEF DESCRIPTION OF THE DRAWING

Many of the attendant advantages of the present invention will become more readily apparent and better understood as the following detailed description is considered in connection with the accompanying drawings in which.

DESCRIPTION OF THE PREFERRED EMBODIMENT

Figure 1:
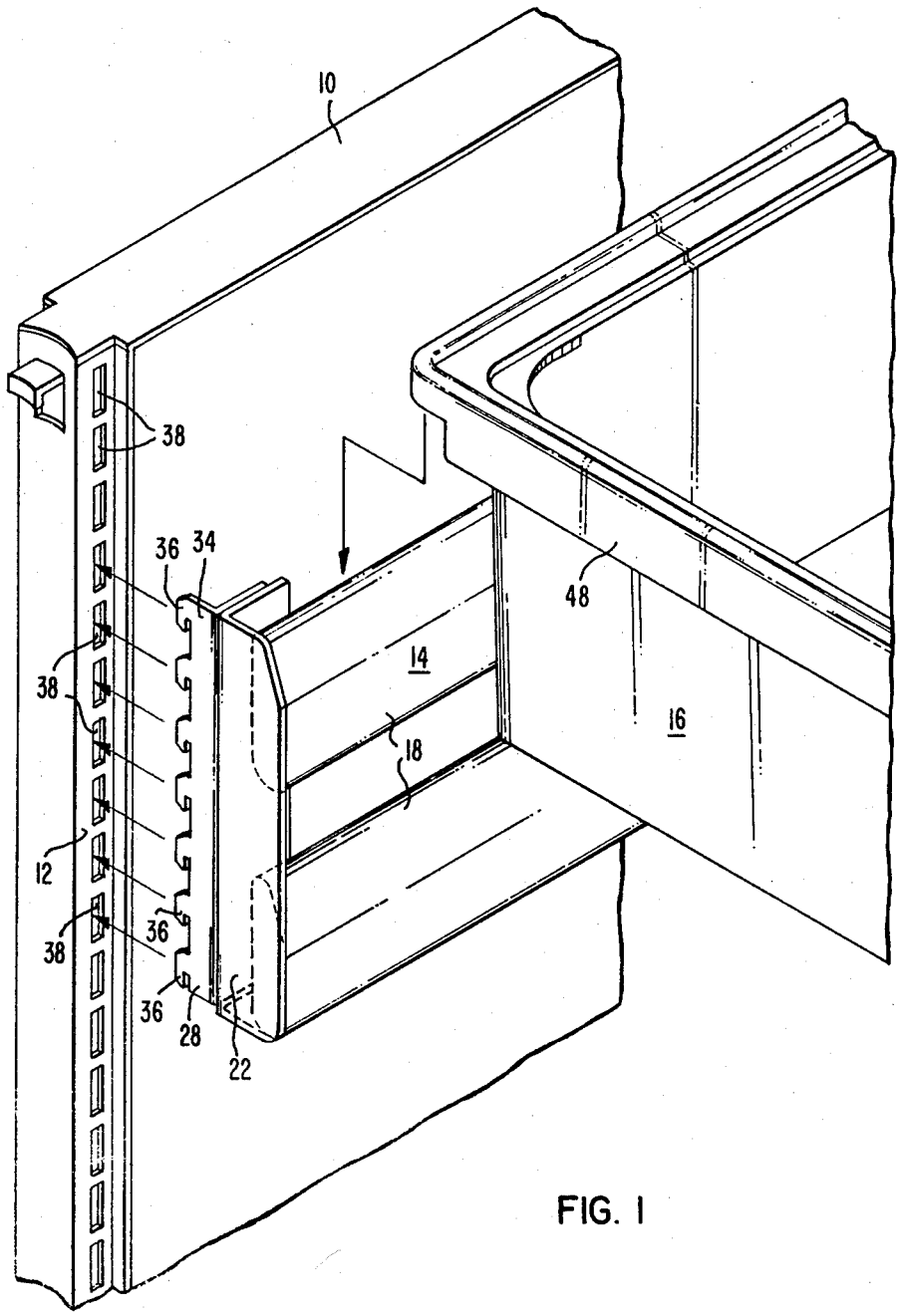
FIG. 1 is a partial exploded view of a vertical wall panel, the wall-hung support rail of this invention and a material handling tote.
Figure 3:
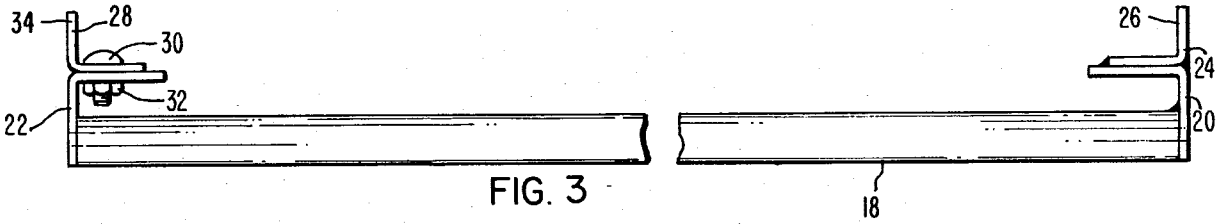
FIG. 3 is a top plan view thereof.
Figure 2:
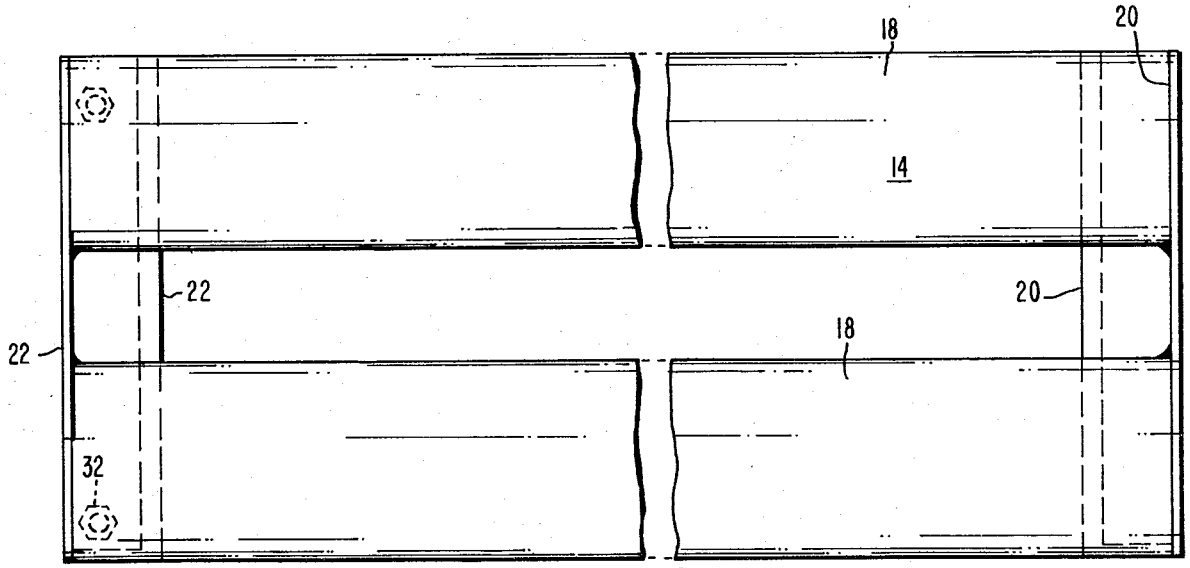
FIG. 2 is a front plan view of the wall-hung support rail of this invention.
Figure 4:
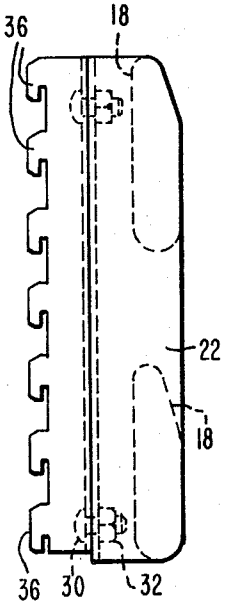
FIG. 4 is a side elevation view thereof.

Referring now in detail to the drawing wherein like reference characters represent like parts throughout the several views, there is illustrated in FIG. 1 a vertical wall panel 10 of the type employed in a space dividing wall panel system similar to that illustrated and described in U.S. Pat. No. 3,762,116 for SPACE DIVIDER SYSTEM AND CONNECTOR ASSEMBLY THEREFOR issued to William C. Anderson et al. Oct. 2, 1973. The wall panel 10 has a slotted standard at each end thereof with the slotted standards being spaced a predetermined distance one from the other. It should be understood that the present invention can be employed with such a modular space dividing wall panel system or alternatively can be mounted to vertically oriented slotted standards fixed in a predetermined lateral spaced relationship directly on the vertical surface of a permanent wall or the like. Referring further to FIG. 1, there is illustrated the wall-hung support rail generally designated 14 which forms the subject matter of this invention and a material handling tote, generally designated 16 which is constructed in accordance with the teachings of copending application Ser. No. 212,946, filed the same date as this application by Charles P. Schreiner et al. and owned by the assignee of this invention. The wall-hung support rail 14 includes, as best illustrated in FIGS. 2–4, a pair of spaced horizontal rails 18 which are mounted at their ends, preferably by welding, to a first pair of L-shaped brackets 20 and 22. The L-shaped bracket 20 is welded to a second L-shaped bracket 24 in such a manner that the bottom leg 26 of the second L-shaped bracket 24 forms an extension of the leg of the L-shaped bracket 20 to which the support rails 18 are mounted. At the other end of the wall-hung support rail 14 is another L-shaped bracket 28 which is similar to the L-shaped bracket 24 with the exception that it is provided with apertures therethrough in order that it may be bolted as by, for example, bolts 30 and nuts 32 to the L-shaped bracket 22 at the other end of the support rails 18. The rearwardly extending leg 26 of the L-shaped bracket 24 and the rearwardly extending leg 34 of the L-shaped bracket 28 are each provided with a series of hook-shaped connectors 36. The hooked shaped connectors 36 of the L-shaped brackets 24 and 28 are constructed to be received within slots 38 of a conventional slotted standard 12 in order to mount the wall-hung support rail of this invention to a vertical wall surface.

Figure 5:
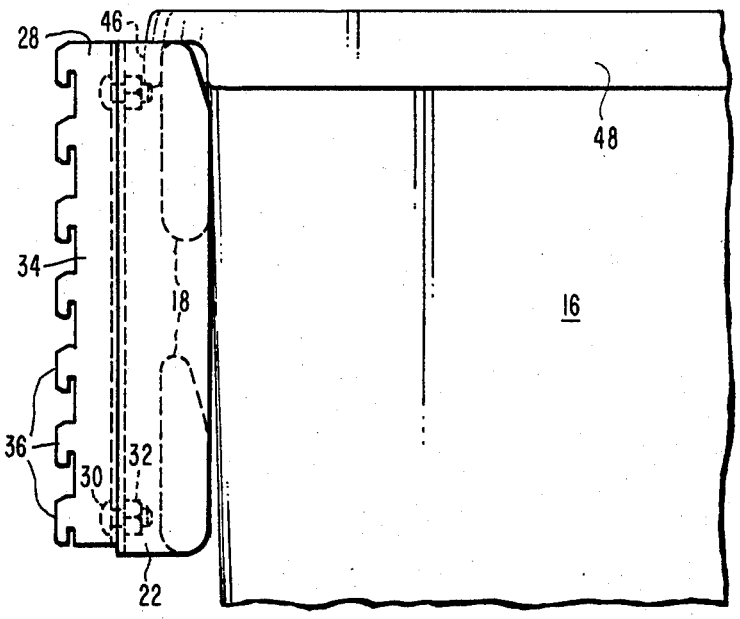
FIG. 5 is a side elevation view similar to FIG. 4 illustrating a large material handling tote thereon.
Figure 6:
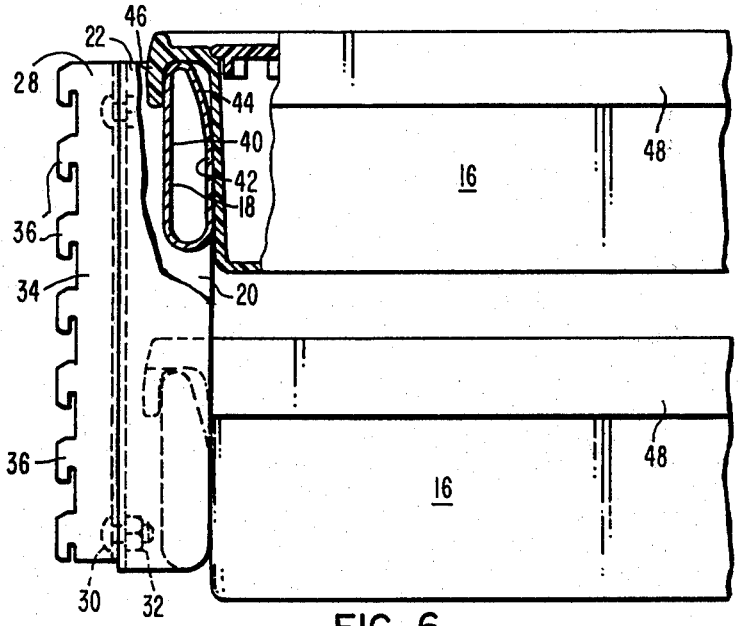
FIG. 6 is a side elevation view similar to FIG. 4 illustrating a pair of smaller material handling totes mounted thereon.

As best illustrated in FIG. 6, the support rails 18 are preferably tubular steel support rails and include a flat back portion 40 and a front portion that is parallel with the back portion for substantially its lower half and tapered toward the back portion 40 for the remaining upper half 44 of the front portion of the tubular steel rail 18. The particular shape of the support rails 18 is important to accommodate material handling totes constructed in accordance with the aforesaid copending applications Ser. No. 212,946 and as illustrated in FIG. 5 are adapted to support the tote 16 in a cantilevered fashion from either a side flange 46 or an end flange 48 with lower support for a larger tote 16 being provided by the lower of the two vertically spaced, parallel support rails 18. The predetermined distance between the support rails 18 should be at least about $1\frac{1}{2}$ inches in order that several smaller material handling totes can be hung from a single support rail in a cantilevered fashion as illustrated in FIG. 6. As will be apparent, with sufficient space being provided between the pair of parallel support rails a smaller tote 16 can be cantilevered from a single rail with the lower flat portion 42 of the rail upon which the smaller tote is hung providing the cantilevered lower support.

Having the L-shaped brackets 20 and 24 welded together to form a solid bracket while the L-shaped brackets 22 and 28 are bolted together with, for example, bolts 30 permits slight play in the space between the leg 34 of bracket 28 and the leg 26 of bracket 24 in order to compensate for slight variations in the spacing of the slotted standards on a vertical surface. This slight adjustability is provided in connection with limited assembly requirements and therefore quicker and easier mounting than if both of the brackets at the ends of the support rails 18 were bolted together.

As will be apparent from the foregoing a simple and effective wall hung support rail has been provided by the present invention to facilitate the storing of small electronic parts at a particular work station in material handling totes. Through the hook-shaped connectors 36 and the adjustability provided through the association of L-shaped bracket 28 and L-shaped bracket 32 the wall-mounted support rail can be quickly and easily mounted to a vertical surface adjacent a work station to provide access to the parts required in a manufacturing process.

What is claimed is:

1. A support rail for use in connection with a panel or similar vertical support member having spaced vertical slotted standards thereon, said support rail comprising:

a pair of vertically spaced rail means, a first L-shaped bracket secured to each end of said pair of rail means, and a second L-shaped bracket secured to each of said first L-shaped brackets, said second L-shaped brackets including a plurality of hook-shaped connectors on one edge thereof constructed and arranged to co-act with a slotted standard to connect said support rail to a vertical surface.

2. The support rail according to claim 1 wherein said pair of vertically spaced rail means are welded to said first L-shaped brackets in a predetermined spaced relationship.

3. The support rail according to claim 1 wherein one of said first L-shaped brackets is welded to one of said second L-shaped brackets and the other of said first L-shaped brackets is bolted to the other of said second L-shaped brackets whereby the spaced relationship of said second L-shaped brackets may be varied.

4. The support rail according to claim 1 wherein said support rails are tubular and include a flat back portion and a front portion that is parallel with said back portion for its lower half and tapered toward said back portion for its upper half.

5. A wall-hung support rail for supporting cantilevered material handling totes on a vertical surface having laterally spaced slotted standards thereon, said support rail comprising:

a pair of first and second L-shaped brackets secured together along an adjacent leg and having the other legs thereof extending in opposite directions in substantially the same plane;

a pair of spaced parallel rail means secured at each of their ends to a first of said other legs of said first L-shaped brackets, said other legs of said second L-shaped brackets having a plurality of hook connectors thereon constructed and arranged to co-act with a slotted standard on said vertical surface to thereby hang said support rail on said wall.

6. The wall-hung support rail according to claim 5 wherein one of said first L-shaped brackets is welded to one of said second L-shaped brackets and the other of said first L-shaped brackets is bolted to the other of said second L-shaped brackets whereby the spaced relationship of said second L-shaped brackets may be varied.

7. The wall-mounted support rail according to claim 5 wherein said pair of spaced parallel rail means are welded at their ends to a first of said other legs of said first L-shaped brackets.

8. The wall-hung support rail according to claim 5 wherein said pair of spaced parallel rail means each include a flat back portion and a front portion that is parallel with said back portion for its lower half and tapered toward said back portion for its upper half.

* * * * *